US006474183B1

(12) United States Patent
Uchikado

(10) Patent No.: US 6,474,183 B1
(45) Date of Patent: Nov. 5, 2002

(54) VARIABLE-DISPLACEMENT INCLINED PLATE COMPRESSOR

(75) Inventor: Iwao Uchikado, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/523,104

(22) Filed: Mar. 10, 2000

(30) Foreign Application Priority Data

Mar. 11, 1999 (JP) ..... 11-064899

(51) Int. Cl.[7] ..... F16C 19/10; F04B 1/12; F16H 23/00

(52) U.S. Cl. ..... 74/60; 74/839; 92/71; 417/222.1

(58) Field of Search ..... 74/839, 60; 92/71, 92/153; 417/222.1

(56) References Cited

U.S. PATENT DOCUMENTS

| | | | | | |
|---|---|---|---|---|---|
| 2,529,898 | A | * | 11/1950 | Batik | 384/513 |
| 4,509,871 | A | * | 4/1985 | Herzog et al. | 384/513 |
| 4,586,874 | A | | 5/1986 | Hiraga et al. | |
| 4,688,997 | A | | 8/1987 | Suzuki et al. | |
| 4,702,677 | A | | 10/1987 | Takenaka et al. | |
| 4,723,891 | A | | 2/1988 | Takenaka et al. | |
| 4,730,986 | A | | 3/1988 | Kayukawa et al. | |
| 4,778,348 | A | | 10/1988 | Kikuchi et al. | |
| 4,780,060 | A | | 10/1988 | Terauchi | |
| 4,842,488 | A | | 6/1989 | Terauchi | |
| 4,940,393 | A | | 7/1990 | Taguchi | |
| 5,531,572 | A | | 7/1996 | Kimura et al. | |
| 5,785,503 | A | * | 7/1998 | Ota et al. | 74/60 |
| 5,941,157 | A | * | 8/1999 | Tokumasu | 92/71 |
| 6,074,173 | A | | 6/2000 | Taguchi | |
| 6,102,670 | A | | 8/2000 | Taguchi | |
| 6,179,572 | B1 | | 1/2001 | Taguchi | |
| 6,196,808 | B1 | | 3/2001 | Taguchi | |

FOREIGN PATENT DOCUMENTS

| | | |
|---|---|---|
| EP | 0219283 | 4/1987 |
| EP | 0855506 | 7/1998 |
| JP | 63205469 | 8/1988 |
| WO | WO9416225 | 7/1994 |

* cited by examiner

*Primary Examiner*—William C Joyce
(74) *Attorney, Agent, or Firm*—Baker Botts L.L.P.

(57) ABSTRACT

A variable-displacement inclined plate compressor includes a drive shaft, a rotor provided on the drive shaft, and an inclined plate provided around the drive shaft and rotated synchronously with the drive shaft via the rotor. The compressor comprises a cam mechanism provided between the rotor and the inclined plate for controlling an inclination angle of the inclined plate relative to an axis of the drive shaft. The cam mechanism comprises a ball located between the rotor and the inclined plate. The cam mechanism prevents improper assembly and facilitates the efficient management of the assembly. Further, the cam mechanism facilitates the processing of parts and the decrease in the number of parts, thereby reducing the manufacturing cost.

7 Claims, 15 Drawing Sheets

VARIABLE-DISPLACEMENT INCLINED PLATE COMPRESSOR

BACKGROUND OF THE INVENTION

1. Field of the Invention

The present invention relates to a variable-displacement inclined plate compressor, and, more specifically, to a variable-displacement inclined plate compressor with an improved structure for a cam mechanism provided between a rotor and an inclined plate in the compressor.

2. Description of Related Art

Variable-displacement inclined plate compressors are known in the art. Variable-displacement inclined plate compressors are used, for example, in a refrigerating cycle of an air conditioner for vehicles. A known structure of a variable-displacement inclined plate compressor is constructed as depicted in FIG. 22. In FIG. 22, variable-displacement inclined plate compressor 100 has cylinder block 103 forming an outline of compressor housing 102, and front housing 105 closing one end of cylinder block 103. Cylinder block 103 includes a plurality of cylinder bores 101. The space enclosed by cylinder block 103 and front housing 105 forms crank chamber 104. Cylinder head 107 is attached to the other end of cylinder block 103 via valve plate 106.

Drive shaft 110 is provided to extend from the outside of front housing 105 to the inside of cylinder block 103 through boss portion 105*a* of front housing 105 and crank chamber 104. One end portion of drive shaft 110 is rotatably supported by bearing 108, which is provided in boss portion 105*a* of front housing 105. The other end portion of drive shaft 110 is rotatably supported by bearing 109, which is provided in through hole 103*a* defined in the central portion of cylinder block 103 to extend in the same direction as the axis of drive shaft 110. Seal member 147 is provided between boss portion 105*a* of front housing 105 and drive shaft 110.

Inclined plate 112 is provided around drive shaft 110 in crank chamber 104. Inclined plate 112 is slidably provided on drive shaft 110 via cylindrical sleeve 111, and rotatably attached to sleeve 111 via pin 111*b* and opening 111*a* (FIG. 23). Inclined plate 112 is rotated synchronously with drive shaft 110 via rotor 116 attached to drive shaft 110. Inclined plate 112 is variable in its inclination angle. Wobble plate 113 is provided around inclined plate 112. Wobble plate 113 is supported by inclined plate 112 via bearings 141 and 142 so that inclined plate 112 can rotate relative to wobble plate 113. The rotation of wobble plate 113 is prevented by rotation preventing mechanism 150. Rotation preventing mechanism 150 comprises guide member 144 extending along the axis direction of drive shaft 110 in crank chamber 104, and engaging member 143 provided on the outer surface of wobble plate 113 for slidably engaging guide member 144. Spring 146 is provided around drive shaft 110 between inclined plate 112 and cylinder block 103. The rotational motion of drive shaft 110 is changed to the wobble motion of wobble plate 113 via rotor 116 and inclined plate 112.

Piston 114 is inserted into each cylinder bore 101. Piston 114 is connected to wobble plate 113 via piston rod 115. One spherical end portion 115*a* of piston rod 115 is contained in spherical hollow portion 114*a* formed in piston 114. The other spherical end portion 115*b* of piston rod 115 is contained in spherical hollow portion 113*a* formed on the side surface of wobble plate 113.

Rotor 116 has arm 116*a* extending in a radially outward direction within a plane which includes the axis of drive shaft 110, and pivot pin 116*b* extending in a direction across the extending direction of arm 116*a*. Rotor 116 is rotatably supported on inner wall surface 105*b* of front housing 105 via thrust bearing 145. Inclined plate 112 has sleeve portion 112*a* projecting toward the side of rotor 116. Slot 112*b* engaging pivot pin 116*b* is defined in sleeve portion 112*a*.

Electromagnetic clutch 120 is provided around boss portion 105*a* for transmitting/interrupting a driving force from an external drive source to drive shaft 110. Electromagnetic clutch 120 comprises electric magnet 123 disposed in pulley 122, which is provided on boss portion 105*a* via bearing 121, clutch plate 125 provided to face one end surface of pulley 122, and fastener 126 for fixing clutch plate 125 to the end of drive shaft 110.

Discharge chamber 132 and suction chamber 133 are defined in cylinder head 107, respectively, by separating the inside of cylinder head 107, closed by valve plate 106, by outer wall 131*a*, bottom wall 131*b* and inner wall 131*c*. Discharge chamber 132 communicates with discharge port 134, which is formed on the wall of cylinder head 107, and discharge port 106*a*, which is formed on valve plate 106. Suction chamber 133 communicates with suction port 135, which is formed on the wall of cylinder head 107, and suction port 106*b*, which is formed on valve plate 106. A suction valve (not shown) is provided on suction port 106*b* to cover suction port 106*b*. A discharge valve (not shown) and retainer 106*c* are provided on discharge port 106*a* in discharge chamber 132 to cover discharge port 106*a*. Control valve 117 is provided between crank chamber 104 and discharge chamber 132. Pressure control valve 117 adjusts the inclination angle of inclined plate 112 by adjusting the pressure in crank chamber 104, thereby controlling the stroke of piston 114. Thus, the displacement of the compressor is controlled by control valve 117.

In such a variable-displacement inclined plate compressor 100, when drive shaft 110 rotates, rotor 116 rotates. By the rotation of rotor 116, inclined plate 112 rotates around drive shaft 110, including wobble movement in a plane containing the axis of drive shaft 110. The rotational motion including the wobble movement of inclined plate 112 is transformed into the wobble movement of wobble plate 113 in the plane containing the axis of drive shaft 110. The wobble movement of wobble plate 113 is transformed into the reciprocal movement of piston 114 in a direction along the axis of drive shaft 110 via piston rod 115. When piston 114 moves from the position depicted in FIG. 22 to a position of the crank chamber side (left side), the fluid is drawn from suction port 135 into cylinder bore 101 through suction chamber 133 and suction port 106*b*. Thereafter, when piston 114 moves toward the cylinder head side (right side), the fluid in cylinder bore 101 is compressed. The compressed fluid is discharged from cylinder bore 101 to the outside of the compressor through discharge port 106*a*, discharge chamber 132 and discharge port 134.

FIG. 23 depicts an exploded view of the cam mechanism including rotor 116 and inclined plate 112 in compressor 100. FIG. 24 is a plan view of the assembled cam mechanism depicted in FIG. 23, and FIGS. 25 and 26 are sectional views of the cam mechanism showing the respective operational conditions.

As depicted in FIG. 23, rotor 116 is fixed to drive shaft 110. Pins 111*b* are inserted from the inside of sleeve 111 in the directions opposite to each other as shown by arrows, and inserted into respective holes 112*d*, which are defined on the inner surface of through hole 112*c* formed in the central portion of inclined plate 112. After sleeve 111 is fixed in through hole 112*c* of inclined plate 112, drive shaft 110 is inserted into sleeve 111.

As depicted in FIGS. 23 and 24, sleeve portion 112*a* of inclined plate 112 is inserted between arm portions 116*a* of rotor 116. Washers 112*e* are interposed between sleeve portion 112*a* and both arm portions 116*a*. Pivot pin 116*b* is inserted through a series of holes, which are formed by holes 116*c* in arm portions 116*a*, the holes of washers 112*e* and slot 112*b* in sleeve portion 112*a*. Snap rings 116*d* are provided on both end portions of pivot pin 116*b* that project through holes 116*c*.

In cam mechanism 140 for a variable-displacement inclined plate compressor, inclined plate 112 and rotor 116 are connected by inserting pivot pin 116*b* into slot 112*b* formed in inclined plate 112 and holes 116*c* formed in rotor 116. Pivot pin 116*b* may be press fitted into the holes for preventing movement, or may be fixed by using snap rings 116*d* after insertion.

On the other hand, a cam mechanism, having a reversed positional relationship between the slot and the hole, is also known. In this type of a cam mechanism, a hole is provided in the inclined plate side, and a slot is provided in the rotor side.

FIG. 25 depicts a condition of minimum cam angle θ min of cam mechanism 140 depicted in FIG. 24, namely, a condition of a minimum angle between an axis perpendicular to the axis of drive shaft 110 and inclined plate 112. In this condition, the displacement for compression of variable-displacement inclined plate compressor 100 is minimized. FIG. 26 depicts a condition of maximum cam angle θ max of cam mechanism 140 depicted in FIG. 24, namely, a condition of a maximum angle between an axis perpendicular to the axis of drive shaft 110 and inclined plate 112. In this condition, the displacement for compression of variable-displacement inclined plate compressor 100 is maximized.

Thus, in known cam mechanism 140 for variable-displacement inclined plate compressor 100, the rotational force is received by the surface contact between arm portions 116*a* of rotor 116 and sleeve portion 112*a* of inclined plate 112. The reactive force of compression is received by the line contact between the inner surface of slot 112*b* of sleeve portion 112*a* and the outer surface of pivot pin 116*b*.

In such a known cam mechanism 140, however, the number of parts, such as the structure for press fitting pivot pin 116*b* or snap rings 116*d*, is great, the assembly may be complicated. Therefore, improper assembly may happen. Moreover, efficient management of the parts and the assembly is difficult.

Further, a tracer control for machining slot 112*b* is required, and its processing is not simple. Moreover,because of a large number of parts, the cost for processing is expensive.

Further, because noise may be created during compression operation resulting from a clearance of the cam in cam mechanism 140, a shim or an increase in the processing grade of parts is required to prevent such noise.

SUMMARY OF THE INVENTION

Accordingly, it is an object of the present invention to provide an improved structure for a cam mechanism in a variable-displacement inclined plate compressor that prevents improper assembly and facilitates the efficient management of the assembly of the cam mechanism.

It is another object of the present invention to provide an improved structure for a cam mechanism in a variable-displacement inclined plate compressor that may facilitate the processing of parts and decrease the number of parts for the cam mechanism, thereby reducing the manufacturing cost.

It is a further object of the present invention to provide an improved structure for a cam mechanism in a variable-displacement inclined plate compressor that may absorb a clearance of a cam by a structure without applying a shim or increasing the processing grade of parts, thereby easily reducing a noise generated during compression operation.

To achieve the foregoing and other objects, a variable-displacement inclined plate compressor according to the present invention is herein provided. The variable-displacement inclined plate compressor includes a drive shaft, a rotor provided on the drive shaft, and an inclined plate provided around the drive shaft and rotated synchronously with the drive shaft via the rotor. The compressor comprises a cam mechanism provided between the rotor and the inclined plate for controlling an inclination angle of the inclined plate relative to an axis of the drive shaft. The cam mechanism comprises a ball which connects between the rotor and the inclined plate.

In the variable-displacement inclined plate compressor, a hole may be defined in one of the rotor and the inclined plate. A groove may be defined in the other of the rotor and the inclined plate. The ball may be contained in the hole and moved along the groove.

In the cam mechanism having such hole and groove, the hole may be formed as a semi-spherical hole, and the groove may be formed in a semi-circular cross section. In this structure, a diameter of the semi-circular cross section of the groove is preferred to be slightly larger than a diameter of the ball. Alternatively, the hole may be formed as a cylindrical hole, and the groove may be formed in a rectangular cross section. Further alternatively, the hole may be formed as a conical hole, and the groove may be formed in a triangular cross section.

In these cam mechanisms, a lubricating oil hole may be provided in at least one of the hole and the groove. Further, the shapes of the holes and grooves may be combined arbitrarily among the above-described shapes.

In the cam mechanism for the variable-displacement inclined plate compressor according to the present invention, the transmission of the driving force and the compression reactive force between the rotor and the inclined plate and the control of the inclination angle of the inclined plate are performed by the cam mechanism formed by the ball, the hole containing the ball, and the groove along which the ball moves. Because it is not necessary to use a pivot pin as in the known cam mechanism, the assembly of the cam mechanism according to the present invention is simpler. Therefore, improper assembly may be prevented. Moreover, the management of the assembly may be efficiently facilitated.

Moreover, because the number of parts in the cam mechanism is reduced as compared with that of the known mechanism, processing of the parts may be easily facilitated, and the manufacturing cost is reduced.

Further, in the cam mechanism according to the present invention, because the clearance of the cam may be automatically absorbed by the structure and the movement of the ball along the groove, any noise created during compression operation may be reduced. Further, because the ball performs a rolling motion during changing the angle of the cam (i.e., the inclination angle of the inclined plate), resistance may be very small, and the displacement of the compressor is smoothly controlled.

Further objects, features, and advantages of the present will be understood from the following detailed description of a preferred embodiment of the present invention with reference to the accompanying figures.

BRIEF DESCRIPTION OF THE DRAWINGS

Embodiments of the invention are now described with reference to the accompanying figures, which are given by way of example only, and are not intended to limit the present invention.

DETAILED DESCRIPTION OF PREFERRED EMBODIMENTS

Figure 22:
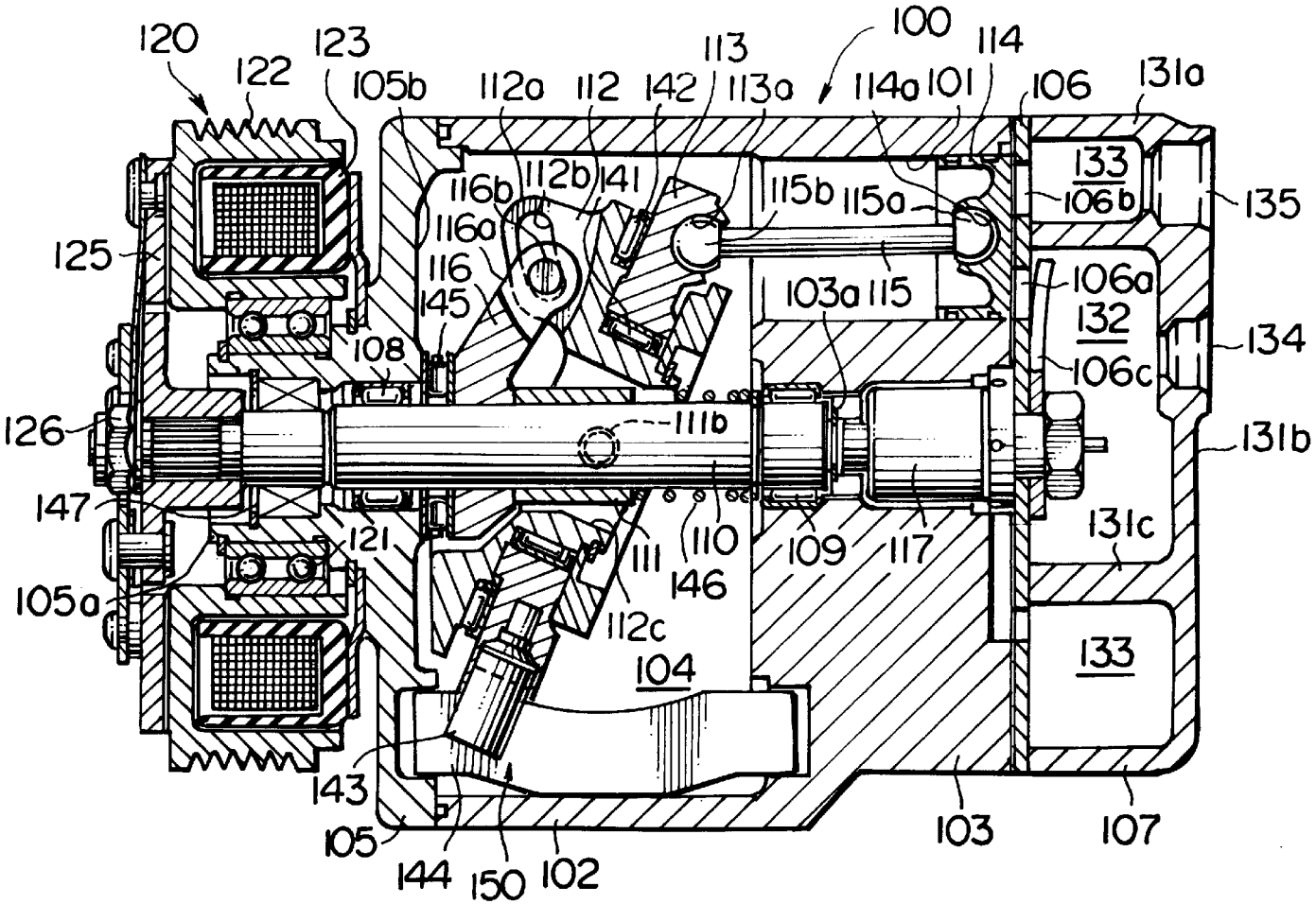
FIG. 22 PRIOR ART
FIG. 22 is a vertical sectional view of a known variable-displacement inclined plate compressor.
Figure 23:
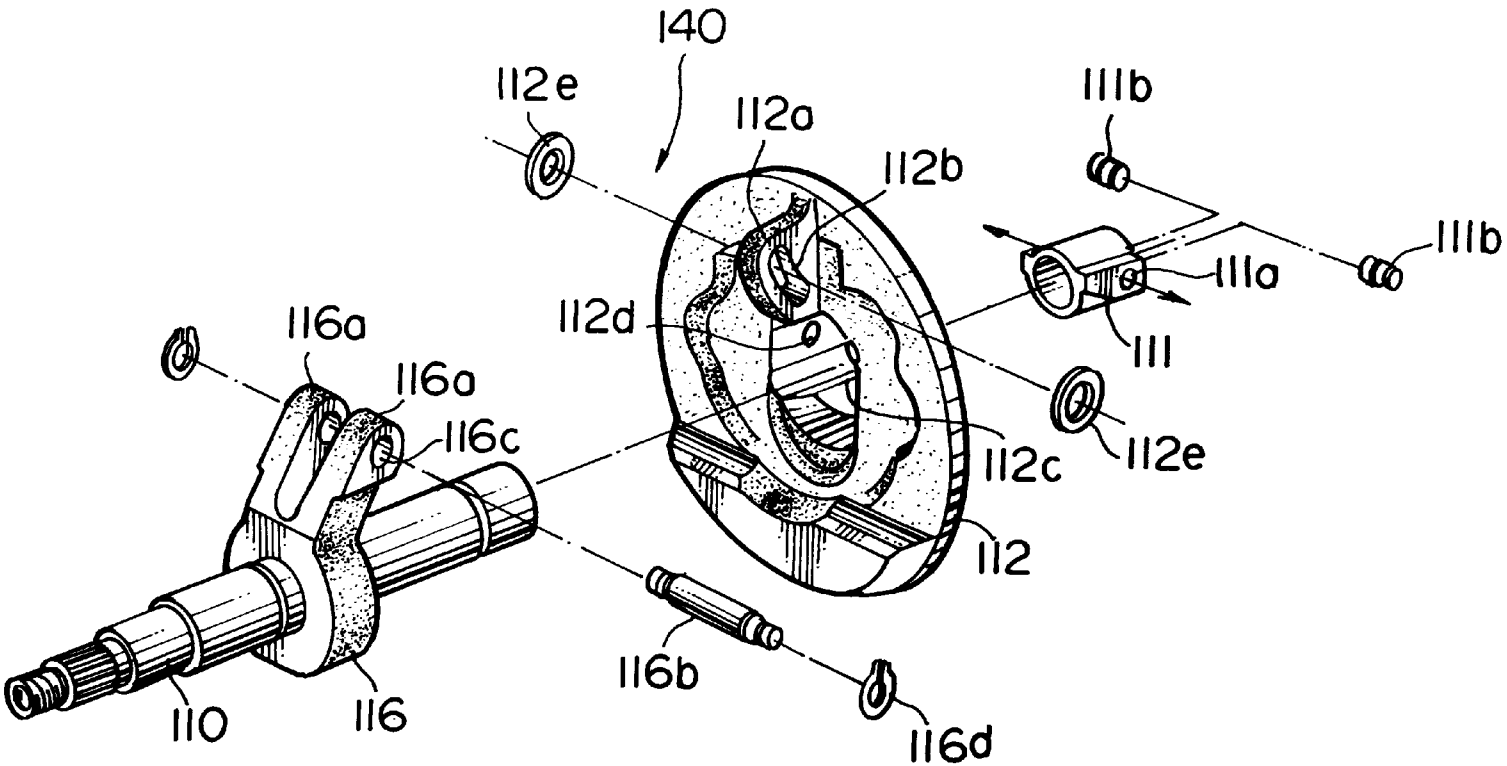
FIG. 23 PRIOR ART
FIG. 23 is an exploded perspective view of a cam mechanism of the variable-displacement inclined plate compressor depicted in FIG. 22.
Figure 24:
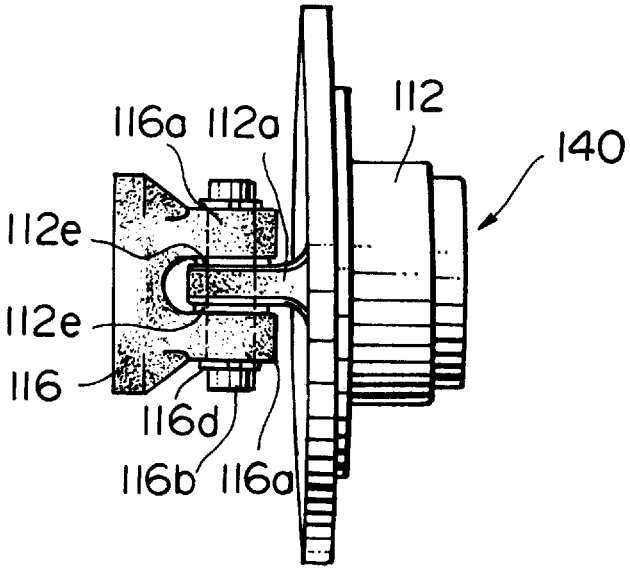
FIG. 24 PRIOR ART
FIG. 24 is a plan view of the cam mechanism depicted in FIG. 23.
Figure 25:
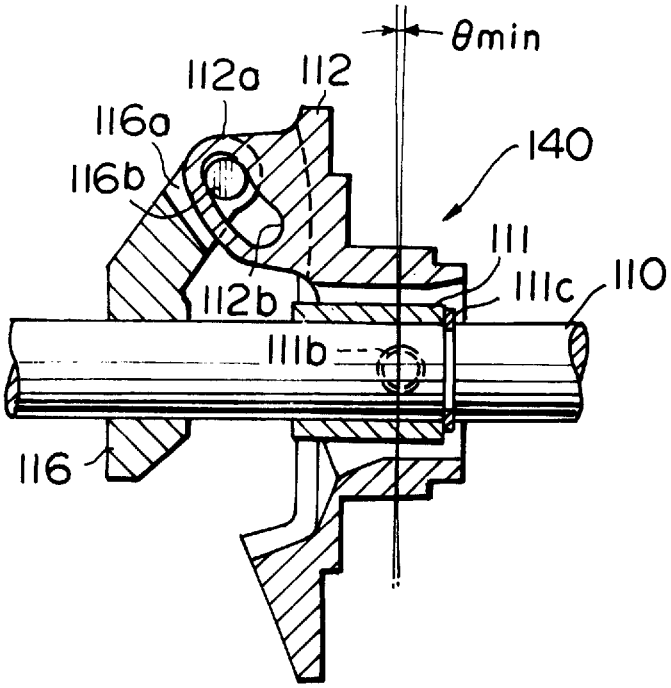
FIG. 25 PRIOR ART
FIG. 25 is a vertical sectional view of the cam mechanism depicted in FIG. 24, showing an operation of the mechanism.
Figure 26:
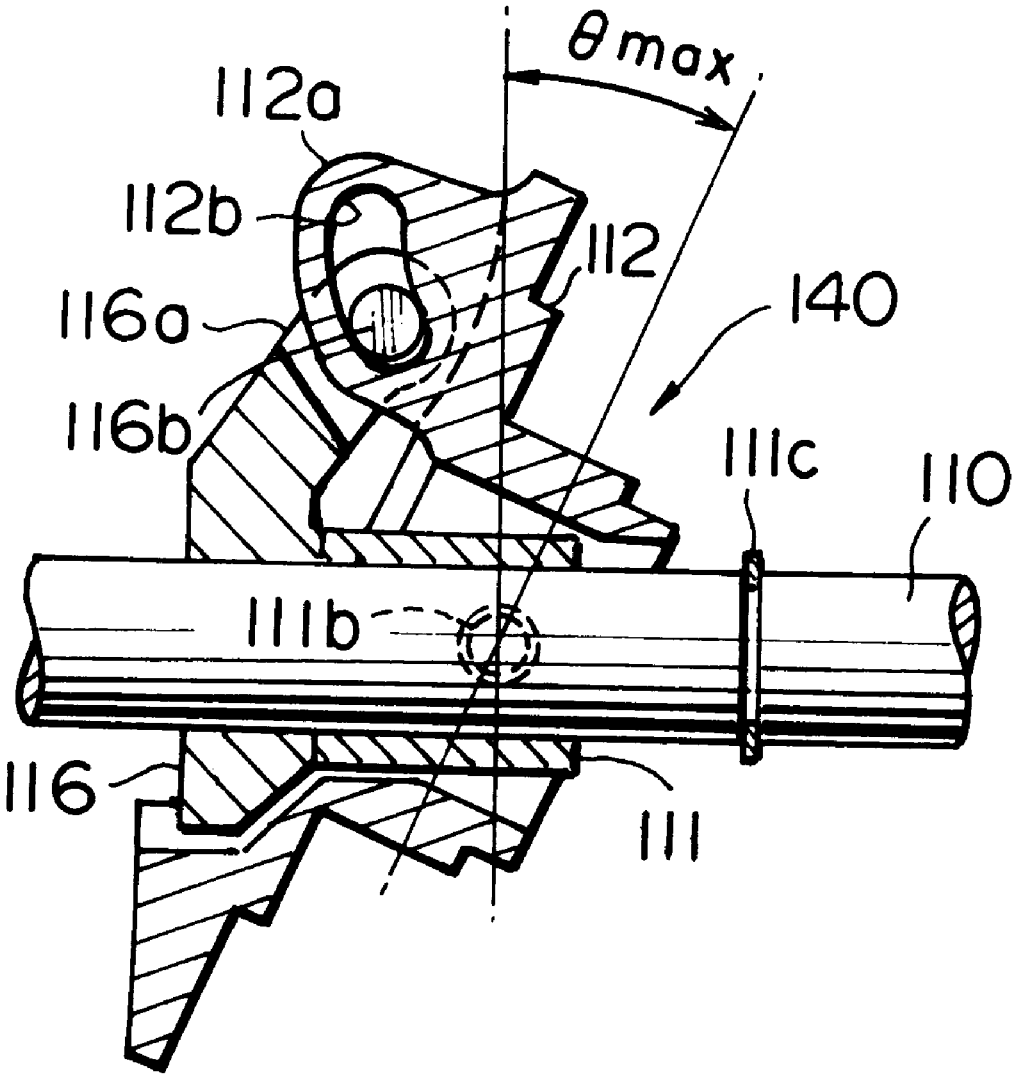
FIG. 26 PRIOR ART
FIG. 26 is a vertical sectional view of the cam mechanism depicted in FIG. 24, showing another operation of the mechanism.

A variable-displacement inclined plate compressor according to the present invention has a similar structure as that of the known compressor depicted in FIG. 22 except for an improved cam mechanism. Therefore, embodiments of the present invention described below will be explained only as to their respective cam mechanisms.

Figure 1:
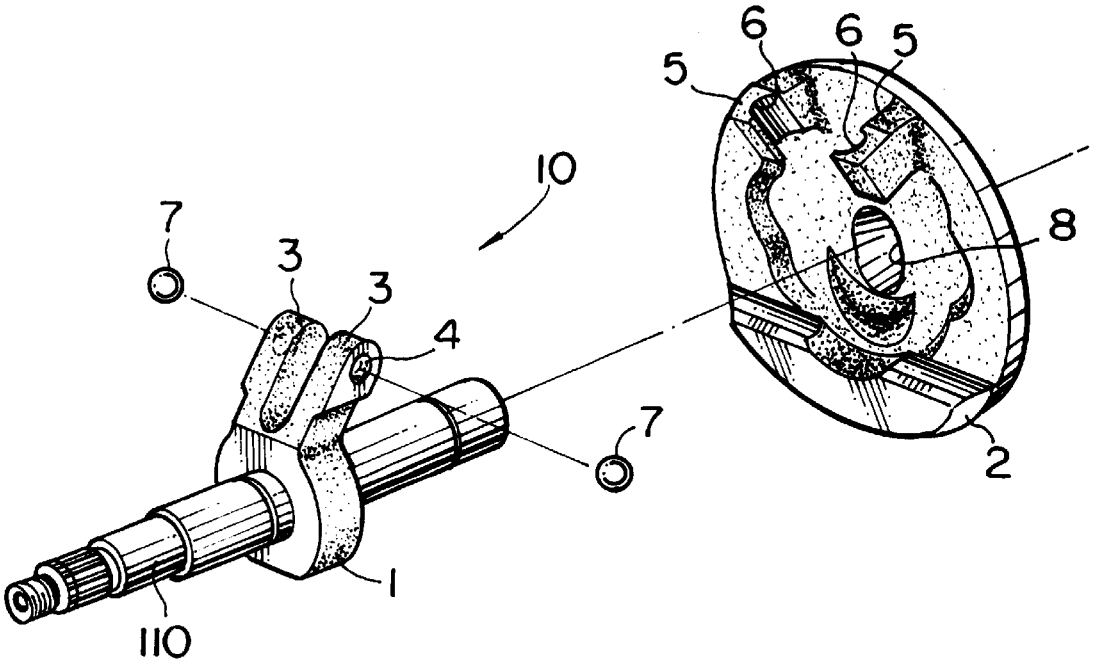
FIG. 1 is an exploded perspective view of a cam mechanism of a variable-displacement inclined plate compressor according to a first embodiment of the present invention.

Referring to FIGS. 1–7, a variable-displacement inclined plate compressor according to a first embodiment of the present invention is provided. In FIG. 1, cam mechanism 10 according to a first embodiment of the present invention includes rotor 1 fixed to drive shaft 110, and inclined plate 2 provided on drive shaft 110 at a position near to rotor 1. Two arm portions 3 are provided in rotor 1 to extend in the same direction, that is directed at a predetermined angle relative to the axis of drive shaft 110. Semispherical hole 4 is defined on the outer side surface of the tip portion of each arm portion 3. A pair of projecting portions 5 are provided on one side surface of inclined plate 2 to extend in the same direction, that is directed at a predetermined angle relative to the axis of drive shaft 110. A pair of grooves 6, each having a semicircular cross section, are defined on the inner side surfaces of the respective projecting portions 5, which face each other. Both grooves 6 extend in the same direction.

Figure 2:
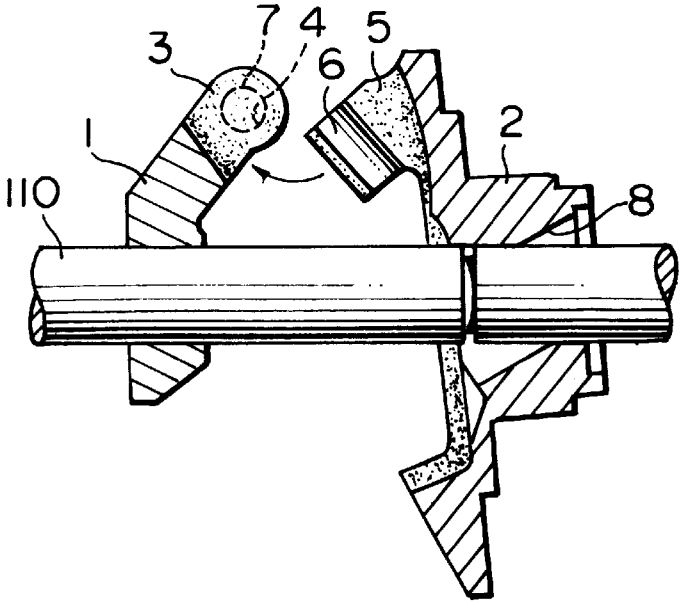
FIG. 2 is a vertical sectional view of the cam mechanism depicted in FIG. 1, showing an assembling method for the cam mechanism.
Figure 3:
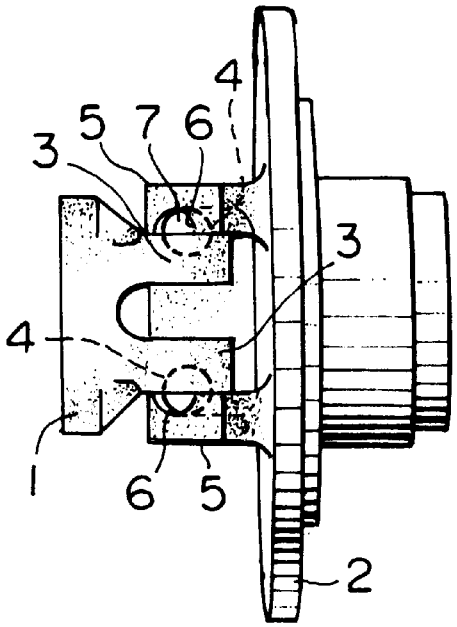
FIG. 3 is a plan view of the cam mechanism depicted in FIG. 1, showing its assembled state.

Referring to FIG. 2, ball 7 is disposed in each hole 4 of each arm portion 3 of rotor 1. In a state in that drive shaft 110 is inserted into through hole 8 of inclined plate 2, the portion of each ball 7 protruded from each hole 4 is inserted into each groove 6 from the end of groove 6. As depicted in FIG. 3, each arm portion 3 and each projecting portion 5 engage each other via each ball 7 disposed in hole 4 and groove 6. Consequently, rotor 1 and inclined plate 2 engage each other in a direction of the axis of drive shaft 110. Thus, the assembly of cam mechanism 10 is completed.

Figure 4:
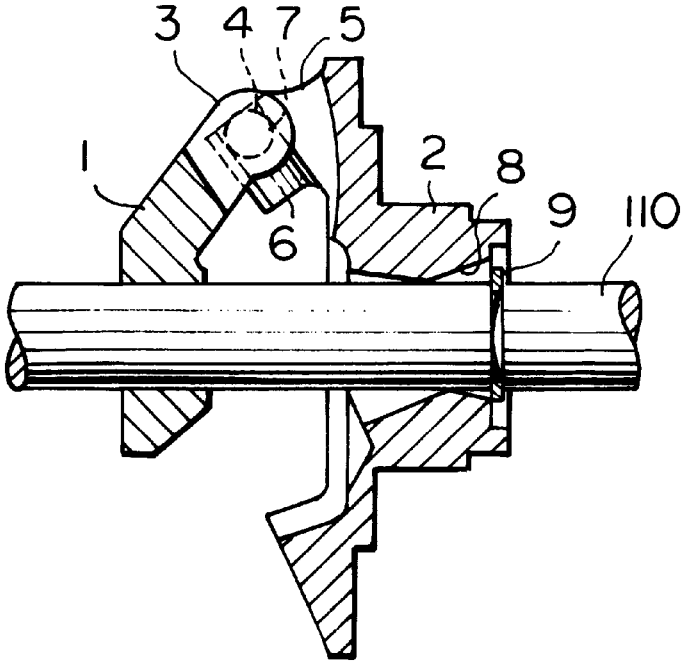
FIG. 4 is a vertical sectional view of the cam mechanism depicted in FIG. 1, showing an operation of the mechanism.

The operation of cam mechanism 10 will be explained. As depicted in FIG. 4, a snap ring 9 is attached to drive shaft 110 at a state of a minimum cam angle, and snap ring 9 is brought into contact with the side surface of inclined plate 2 opposite to the side surface provided with projecting portions 5. By this, inclined plate 2 is set at a minimum cam angle θ min by snap ring 9, and each ball 7 is held in each groove 6 at that position.

Figure 5:
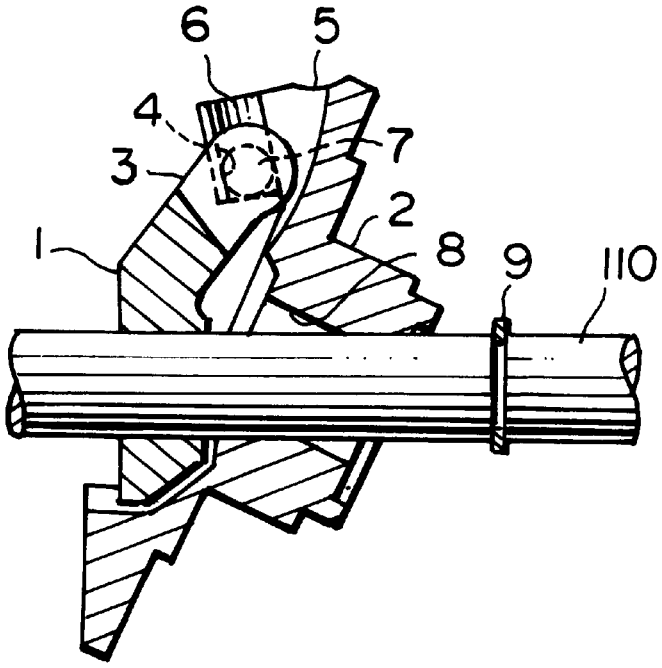
FIG. 5 is a vertical sectional view of the cam mechanism depicted in FIG. 1, showing another operation of the mechanism.

As depicted in FIG. 5, when the cam angle is at a maximum cam angle θ max, the peripheral surface of drive shaft 110 comes into contact with the inner surface of a part of through hole 8 of inclined plate 2, thereby regulating the maximum cam angle θ max. Also in this condition, each ball 7 is held in each respective groove 6 at its position near drive shaft 110.

Although inclined plate 2 is supported on drive shaft 110 via through hole 8 having a saddle shape in this first embodiment, a supporting mechanism using a sleeve as depicted in FIG. 22 may be employed.

As depicted in FIG. 5, when inclined plate 2 is inclined, ball 7 moves along groove 6 having a semicircular cross section. Therefore, inclined plate 2 is inclined while a cam motion, whose top dead center is determined at a constant position by the position of groove 6 and the supporting of the center portion, is performed. If the diameter of groove 6 having a semicircular cross section and the diameter of hole 4 are set to be slightly larger than the diameter of ball 7, ball 7 can slightly move even in the fitting condition. Therefore, when cam mechanism 10 receives a rotation force or a compression reactive force, ball 7 may come into close contact with both of inclined plate 2 and rotor 1. Consequently, a clearance between these members may be well absorbed, and a noise caused by any vibration may be reduced. Thus, the force transmission between rotor 1 and inclined plate 2 may be smoothly performed by the engaging mechanism for inserting ball 7 into both of hole 4 and groove 6.

Figure 6:
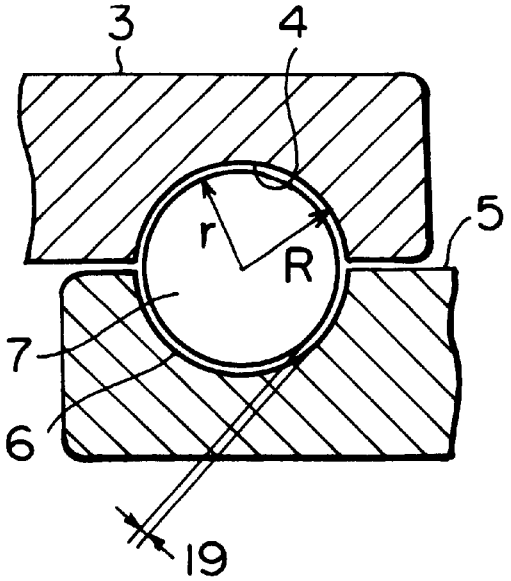
FIG. 6 is a sectional view of a part of the cam mechanism depicted in FIG. 1, showing a ball engaging a hole and a groove in an unloaded condition.
Figure 7:
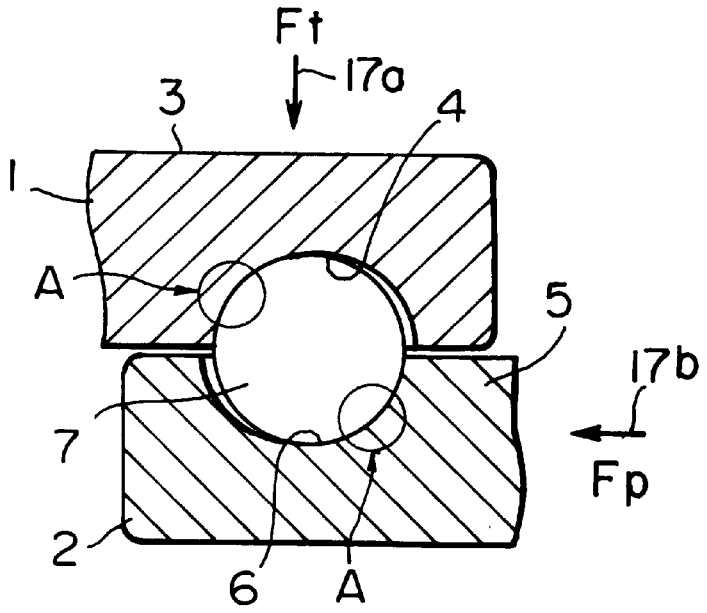
FIG. 7 is a sectional view of a part of the cam mechanism depicted in FIG. 1, showing a ball engaging a hole and a groove in a loaded condition.

FIGS. 6 and 7 depict the states of connection between semispherical hole 4 of rotor 1 and semicircular cross-section groove 6 of inclined plate 2. FIG. 6 depicts an unloaded state, and FIG. 7 depicts a loaded state.

Referring to FIG. 6, radius R of semispherical hole 4 and semicircular cross-section groove 6 is set to be slightly larger than radius "r" of ball 7 (R>r). When inclined plate 2 and rotor 1 are connected, a clearance 19 is generated between the inner surfaces of hole 4 and groove 6 and the surface of ball 7. In this condition, because ball 7 is independent from the respective inner surfaces of hole 4 and groove 6, ball 7 may freely move in the space formed by hole 4 and groove 6.

Referring to FIG. 7, rotation force Ft shown by arrow 17*a* is applied from the upper side in the figure, and compression reactive force Fp shown by arrow 17*b* is applied from the right side in the Figure. When these two forces Ft and Fp are received, and because ball 7 can move as described above, ball 7 comes into contact with both the hole 4 and groove 6 at portions A shown in the figure. In such a condition, the above-described clearance 19 becomes zero, and at the same time, the resistance decreases.

Figure 8:
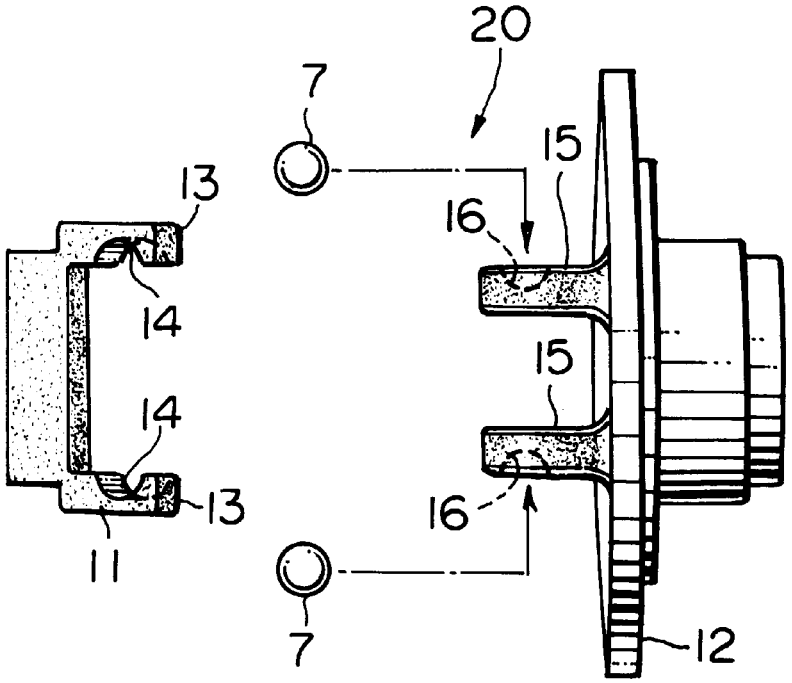
FIG. 8 is an exploded plan view of a cam mechanism of a variable-displacement inclined plate compressor according to a second embodiment of the present invention.
Figure 9:
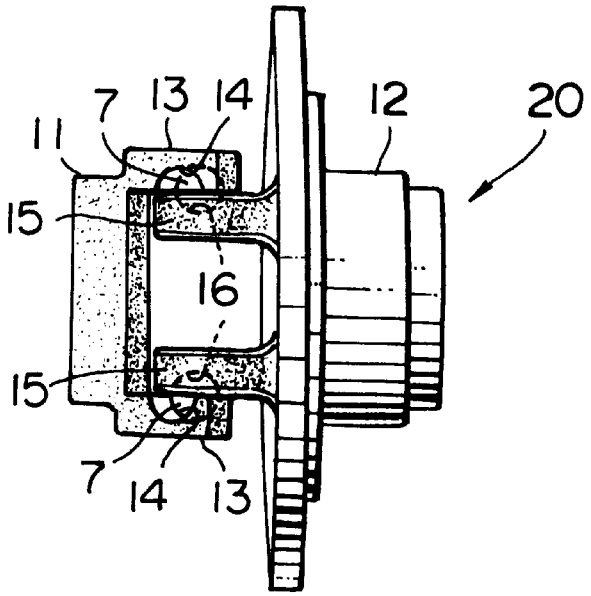
FIG. 9 is a plan view of the cam mechanism depicted in FIG. 8, showing its assembled state.

FIGS. 8–11 depict a cam mechanism of a variable-displacement inclined plate compressor according to a second embodiment of the present invention. As depicted in FIG. 8, in this embodiment, although rotor 11 and inclined plate 12 are provided in cam mechanism 20, the positional relationship between the hole and the groove formed on them is reversed relative to that in the first embodiment. A pair of projecting portions 13 are provided on rotor 11 to extend in the same direction, and grooves 14 are defined on the inner surfaces of projecting portions 13 facing each other. A pair of arm portions 15 are provided on inclined plate 12, and semispherical holes 16 are defined on the outer side surfaces of respective arm portions 15. Ball 7 is inserted into each hole 16. The portion of ball 7 protruded from hole 16 is inserted into groove 14. Thus, rotor 11 and inclined plate 12 engage each other via balls 7 inserted into respective holes 16 and grooves 14. FIG. 9 depicts the completed assembly condition.

Figure 10:
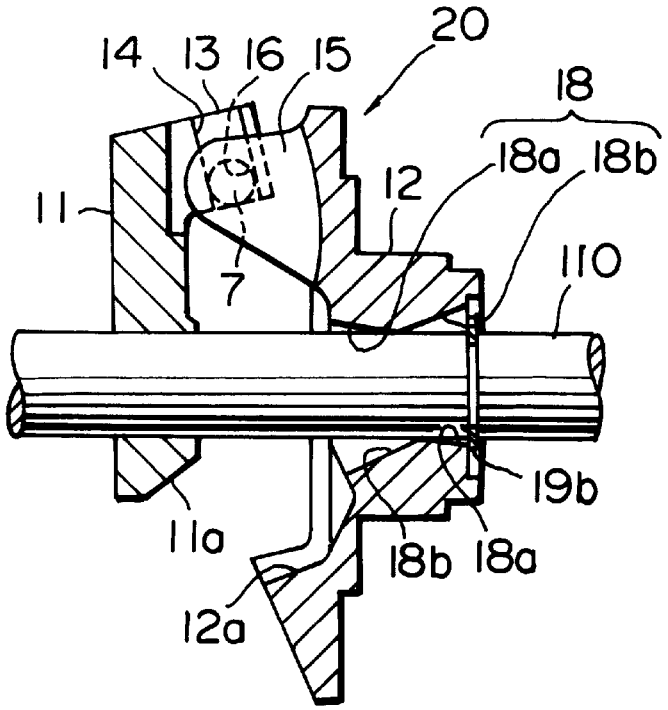
FIG. 10 is a vertical sectional view of the cam mechanism depicted in FIG. 8, showing an operation of the mechanism.

FIG. 10 depicts a condition of minimum cam angle of cam mechanism 20. In this condition, ball 7 is present at a position near drive shaft 110 in groove 14. In the central portion of inclined plate 12, through hole 18 is provided to extend along the axis of drive shaft 110. Through hole 18 has a first inner surface 18*a*, and a second inner surface 18*b* inclined at an acute angle relative to first inner surface 18*a*. In the condition depicted in FIG. 10, the minimum cam angle may be regulated by bringing snap ring 19*b* into contact with one side surface of inclined plate 12. The first inner surface 18*a* is slightly inclined relative to the peripheral surface of drive shaft 110, because it may be necessary to set the angle of the first inner surface 18*a* smaller than the minimum cam angle for the assembly of rotor 11 and inclined plate 12. Therefore, this first inner surface 18*a* is not used for the regulation of the cam angle.

Figure 11:
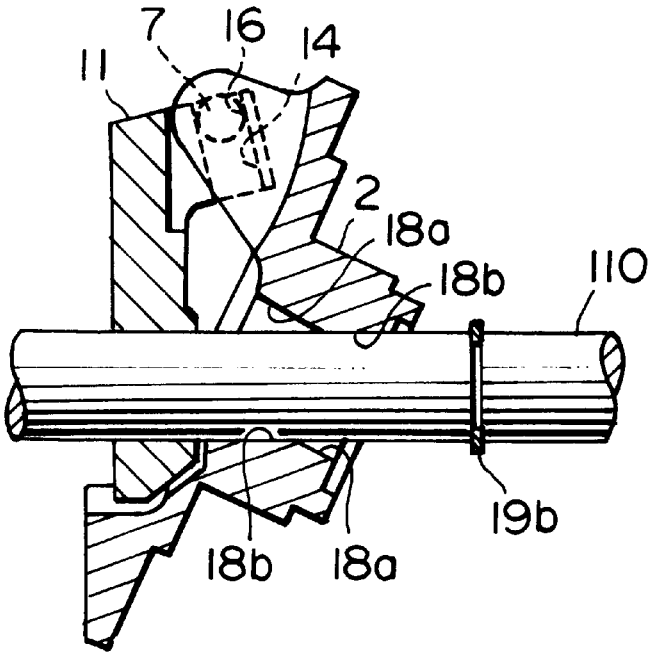
FIG. 11 is a vertical sectional view of the cam mechanism depicted in FIG. 8, showing another operation of the mechanism.

FIG. 11 depicts a condition of maximum cam angle of cam mechanism 20. In this condition, ball 7 is present at the farthermost position away from drive shaft 110.

Figure 12:
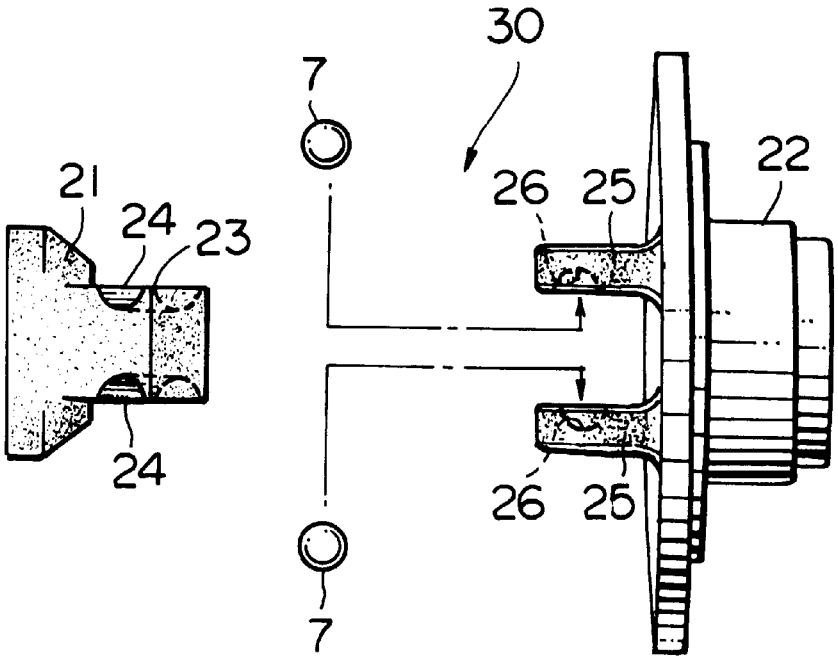
FIG. 12 is an exploded plan view of a cam mechanism of a variable-displacement inclined plate compressor according to a third embodiment of the present invention.

FIG. 12 depicts a cam mechanism of a variable-displacement inclined plate compressor according to a third embodiment of the present invention. In FIG. 12, a single arm portion 23 is provided on rotor 21 of cam mechanism 30. Grooves 24 each having a semicircular cross section are defined symmetrically on the respective outer side surfaces of portion 23. A pair of projecting portions 25 are provided on inclined plate 22. Holes 26, each having a semispherical shape, are defined symmetrically on the respective inner side surfaces of projecting portions 25. When cam mechanism 30 is assembled, after balls 7 are inserted into respective holes 26, the portions of balls 7 that protrude from holes 26 are inserted into respective grooves 24. Balls 7 engage both of holes 26 and grooves 24, thereby engaging rotor 21 and inclined plate 22 in the direction of the axis of the drive shaft. In this embodiment, although arm portion 23 of rotor 21 is formed as a single arm portion, the operation may be substantially the same as compared with that in a mechanism having a plurality of arm portions. Therefore, in cam mechanism 30 according to this third embodiment, substantially the same advantages as those in the first and second embodiments may be obtained.

Figure 13:
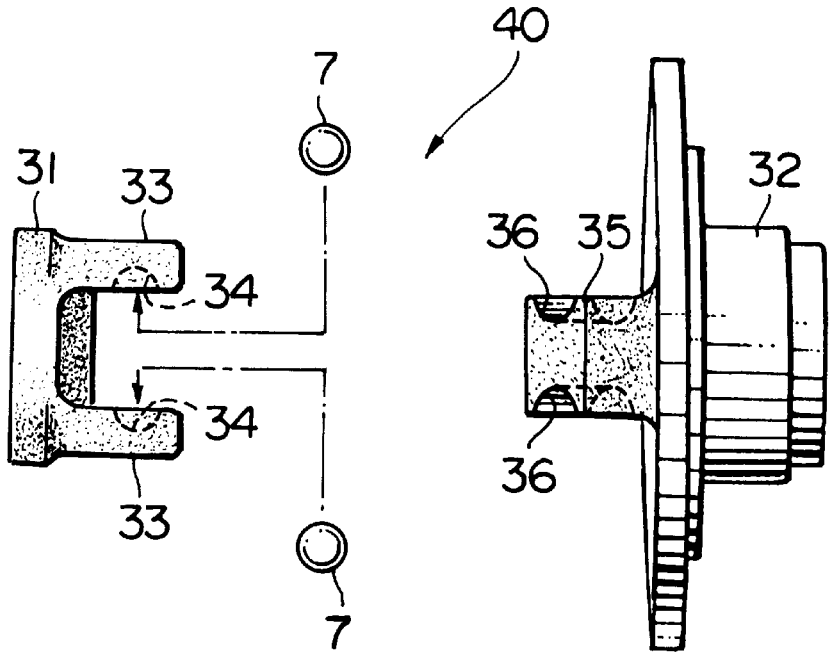
FIG. 13 is an exploded plan view of a cam mechanism of a variable-displacement inclined plate compressor according to a fourth embodiment of the present invention.

FIG. 13 depicts a cam mechanism of a variable-displacement inclined plate compressor according to a fourth embodiment of the present invention. In FIG. 13, cam mechanism 40 includes rotor 31 and inclined plate 32. A pair of arm portions 33 are provided on rotor 31 to extend in the same direction. Semispherical holes 34 are defined on the inner side surfaces of respective arm portions 33, which face each other. A single projecting portion 35 is provided on inclined plate 32. Grooves 36 each having a semicircular cross section are defined on the respective outer side surfaces of projecting portion 35. When cam mechanism 40 is assembled, after balls 7 are inserted into respective holes 34, the portions of balls 7 that protrude from holes 34 are inserted into respective grooves 36. Balls 7 engage both of holes 34 and grooves 36, thereby engaging rotor 31 and inclined plate 32 in the direction of the axis of the drive shaft. In this embodiment, although projecting portion 35 is formed as a single projecting portion, a plurality of projecting portions may be provided on inclined plate 32. In cam mechanism 40 according to this fourth embodiment, substantially the same advantages as those in the first through third embodiments may be obtained.

Figure 14:
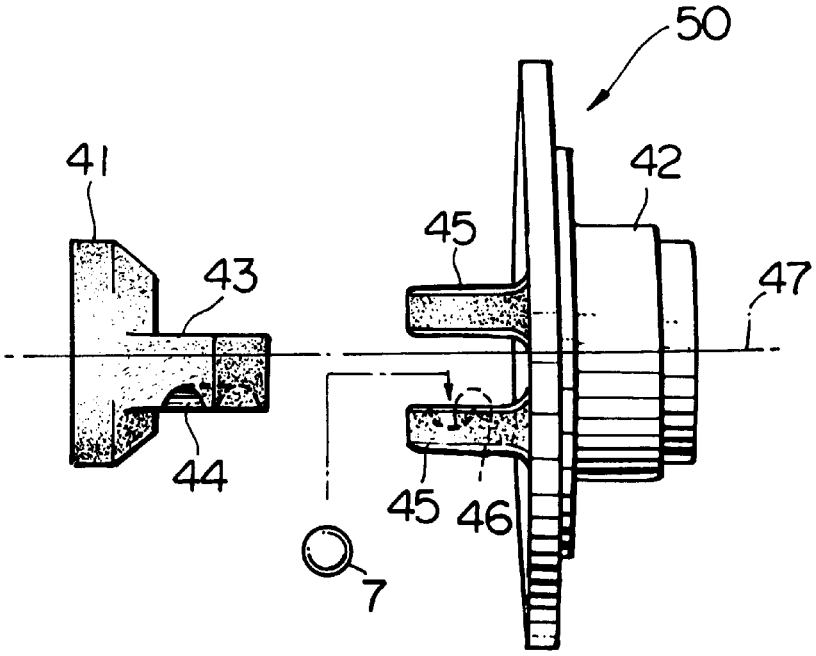
FIG. 14 is an exploded plan view of a cam mechanism of a variable-displacement inclined plate compressor according to a fifth embodiment of the present invention.
Figure 15:
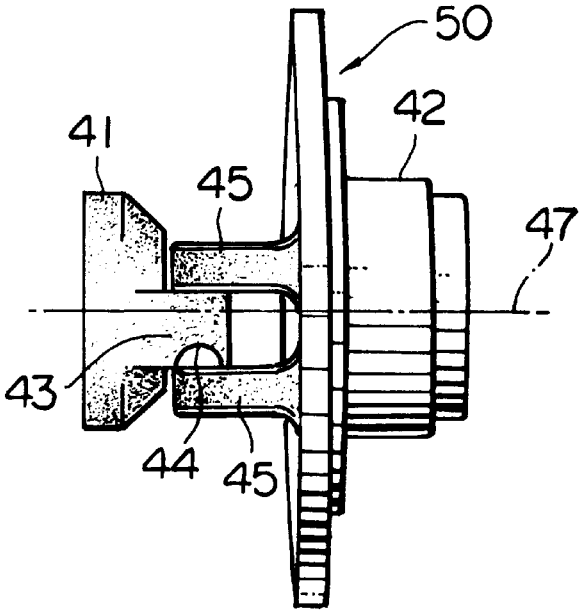
FIG. 15 is a plan view of the cam mechanism depicted in FIG. 14, showing its assembled state.

FIGS. 14 and 15 depict a cam mechanism of a variable-displacement inclined plate compressor according to a fifth embodiment of the present invention. In FIG. 14, cam mechanism 50 includes rotor 41 and inclined plate 42. A single arm portion 43 is provided on rotor 41. Groove 44 having a semicircular cross section is defined on a side surface of arm portion 43, which is the surface farthest from center axis 47 of rotor 41. A pair of projecting portions 45 are provided on inclined plate 42 to extend along center axis 47. Spherical hole 46 is defined on the inner side surface of one of projecting portions 45. When cam mechanism 50 is assembled, after ball 7 is inserted into hole 46 defined on one of projecting portions 45, arm portion 43 is inserted between the pair of projecting portions 45 so that the portion of ball 7 protruded from hole 46 is inserted into groove 44. Ball 7 engages both hole 46 and groove 44, thereby engaging rotor 41 and inclined plate 42 in the direction of the axis of the drive shaft. Thus, the assembly of cam mechanism 50 is completed as depicted in FIG. 15. Although arm portion 43 is provided at a position eccentric from center axis 47 and respective projecting portions 45 are provided at nonsymmetric positions relative to center axis 47, arm portion 43 may be provided at a position of center axis 47 and respective projecting portions 45 may be provided at symmetric positions relative to center axis 47. In cam mechanism 50 according to this fifth embodiment, substantially the same advantages as those in the first through fourth embodiments may be obtained.

Figure 16:
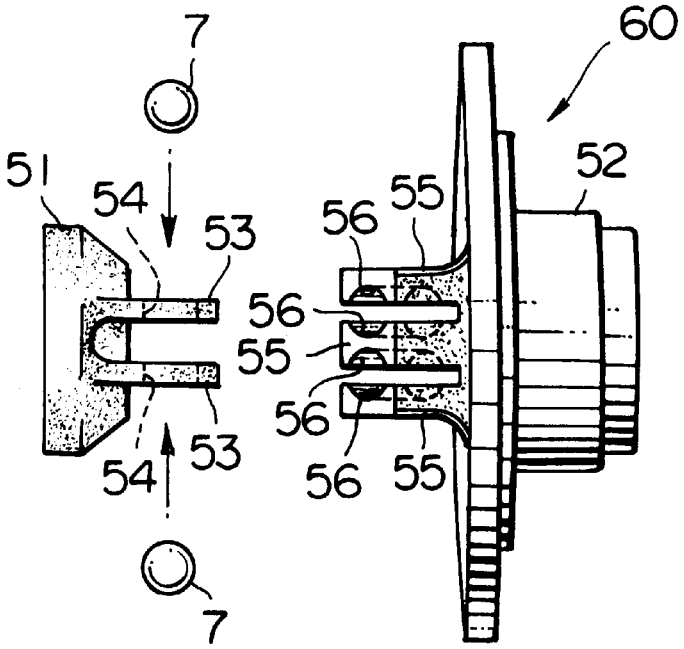
FIG. 16 is an exploded plan view of a cam mechanism of a variable-displacement inclined plate compressor according to a sixth embodiment of the present invention.
Figure 17:
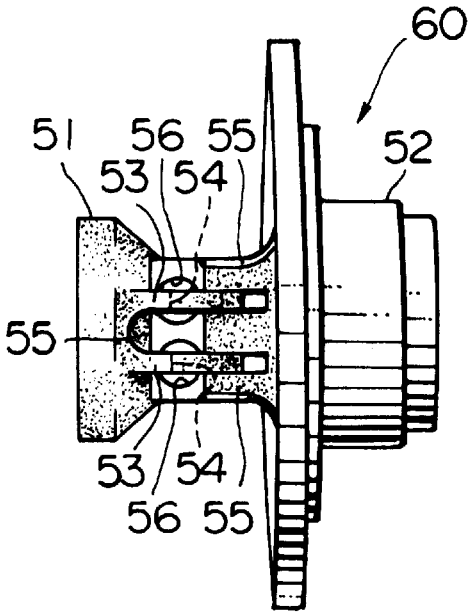
FIG. 17 is a plan view of the cam mechanism depicted in FIG. 16, showing its assembled state.

FIGS. 16 and 17 depict a cam mechanism of a variable-displacement inclined plate compressor according to a sixth embodiment of the present invention. In FIG. 16, cam mechanism 60 includes rotor 51 and inclined plate 52. A pair of arm portions 53 are provided on rotor 51. Through holes 54 are defined on respective arm portions 53 to extend in the same direction at the corresponding positions. Three projecting portions 55 are provided on inclined plate 52. Grooves 56 each having a semicircular cross section are defined on respective side surfaces of respective projecting portions 55, which face each other. When cam mechanism 60 is assembled, after balls 7 are inserted into respective through holes 54 defined on respective arm portions 53, respective projecting portions 55 are moved between arm portions 53 and toward the outside positions of arm portions 53 so that the portions of balls 7 protruded from holes 54 are inserted into grooves 56. Balls 7 engage both holes 54 and grooves 56, thereby engaging rotor 51 and inclined plate 52 in the direction of the axis of the drive shaft. Thus, the assembly of cam mechanism 60 is completed as depicted in FIG. 17. In cam mechanism 60 according to this sixth embodiment, substantially the same advantages as those in the first through fifth embodiments may be obtained.

Figure 18:
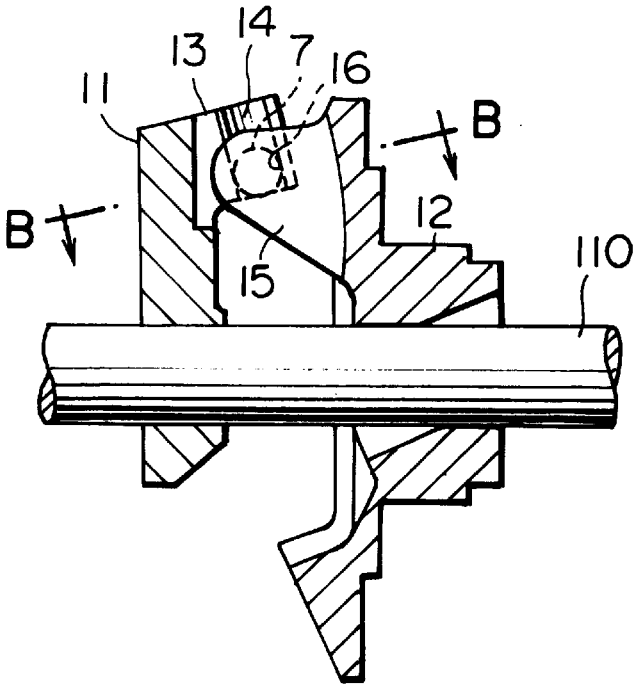
FIG. 18 is a vertical sectional view of a cam mechanism according to the present invention, showing the same condition as that depicted in FIG. 10.

In the above-described embodiments, various shapes for a hole containing a ball and a groove engaging the ball may be employed. FIG. 18 depicts a cam mechanism according to the present invention, and shows the same condition as that depicted in FIG. 10. FIGS. 19A–19D and FIGS. 20A–20D are cross-sectional views as viewed along line B—B of FIG. 18; FIGS. 19A–19D depict various shapes of a rotor side; and FIGS. 20A–20D depict various shapes of an inclined plate side.

Figure 19A:
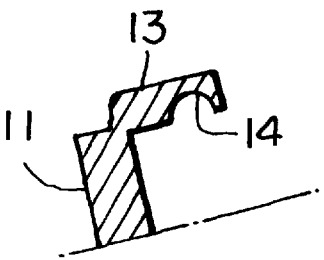
FIGS. 19A–19D are cross-sectional views of rotor sides of various cam mechanisms according to the present invention, as viewed along line B—B of FIG. 18.
Figure 19B:
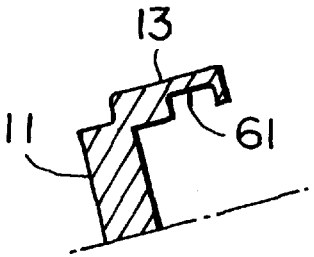
Figure 19C:
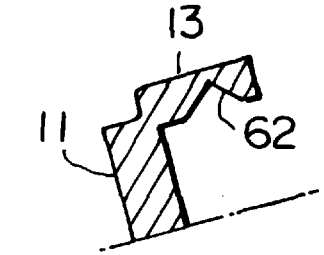
Figure 19D:
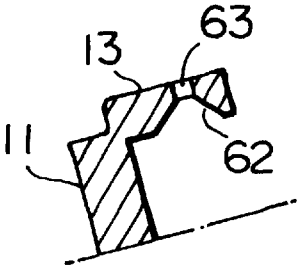
Figure 20A:
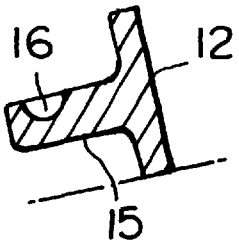
FIGS. 20A–20D are cross-sectional views of inclined plate sides of various cam mechanisms according to the present invention, as viewed along line B—B of FIG. 18.
Figure 20B:
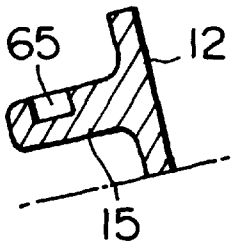
Figure 20C:
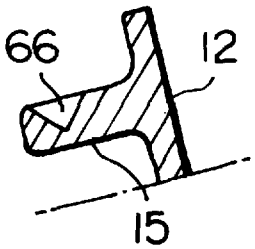
Figure 20D:
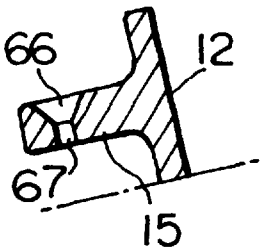

FIG. 19A depicts groove 14, having a semicircular cross section, which is formed on arm portion 13 of rotor 11 in the second embodiment. FIG. 20A depicts spherical hole 16 formed on projecting portion 15 of inclined plate 12 in the second embodiment. FIG. 19B and FIG. 20B show a first modification of the cam mechanism depicted in FIGS. 19A and 20A. In FIG. 19B, groove 61 formed on arm portion 13 of rotor 11 has a rectangular cross section. In FIG. 20B, hole 65 formed on projecting portion 15 of inclined plate 12 has a cylindrical shape. FIG. 19C and FIG. 20C show a second modification of the cam mechanism depicted in FIGS. 19A and 20A. In FIG. 19C, groove 62 formed on arm portion 13 of rotor 11 has a triangular cross section. In FIG. 20C, hole 66 formed on projecting portion 15 of inclined plate 12 has a conical shape. FIG. 19D and FIG. 20D show a third modification of the cam mechanism depicted in FIGS. 19A and 20A. In FIG. 19C, lubricating oil hole 63 is defined in arm portion 13 of rotor 11 to communicate triangular groove 62. In FIG. 20D, lubricating oil hole 67 is defined on the bottom portion of conical hole 66 to communicate conical hole 66. Thus, various modifications may be employed.

Although the above-described modifications have been explained as modifications of the second embodiment, such modifications may be applied to other embodiments including a seventh embodiment described later. Further, in the present invention, the shapes of the groove and the hole are not limited to the above-described shapes of circular, spherical, rectangular, triangular and conical shapes. Other shapes such as polygonal and oval shapes, that can hold or engage a ball, may be employed.

Figure 21:
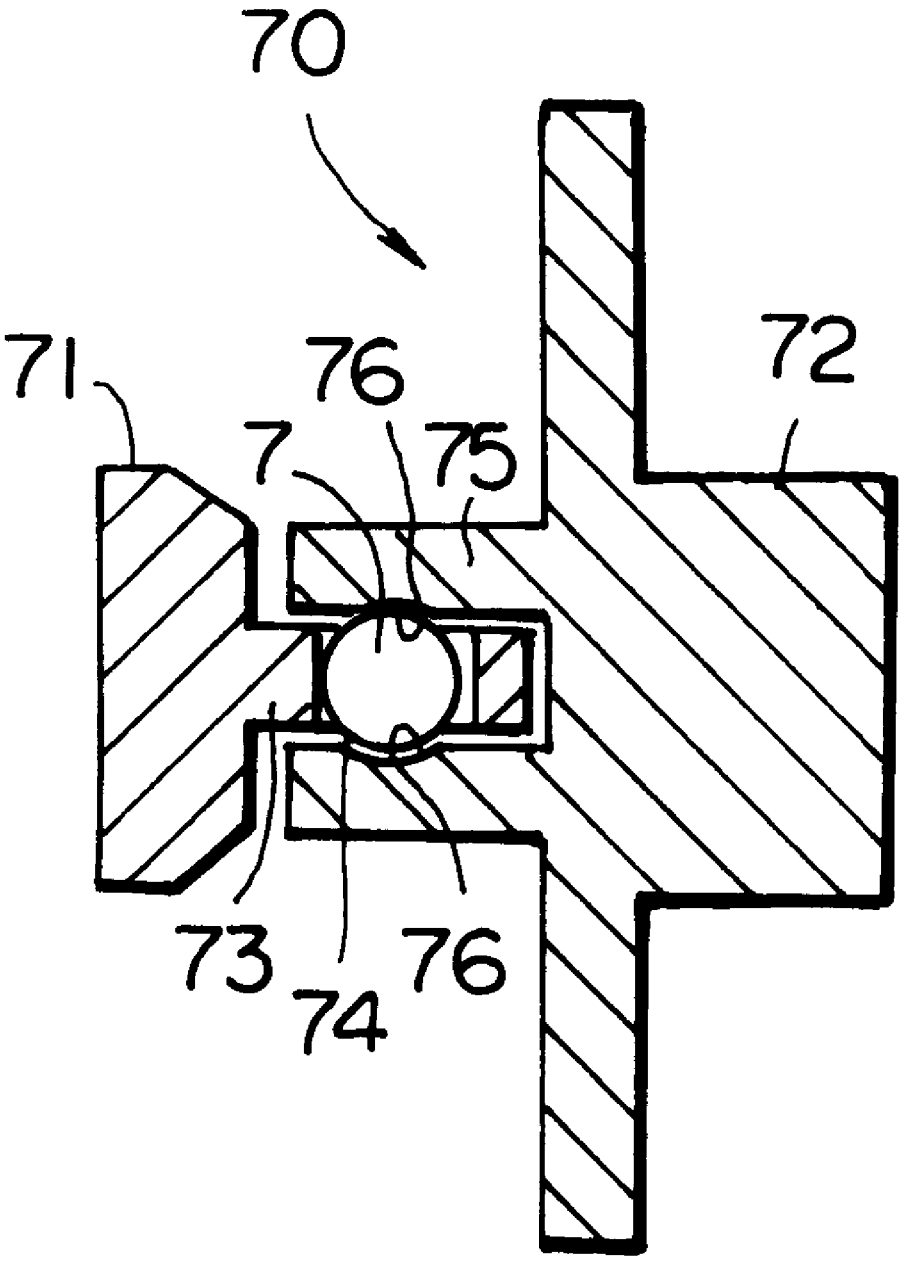
FIG. 21 is a cross-sectional view of a cam mechanism of a variable-displacement inclined plate compressor according to a seventh embodiment of the present invention.

FIG. 21 depicts a cam mechanism of a variable-displacement inclined plate compressor according to a seventh embodiment of the present invention. In FIG. 21, cam mechanism 70 includes rotor 71 and inclined plate 72. A single arm portion 73 is provided on rotor 71 at the central portion of rotor 71. Through hole 74 is defined in arm portion 73 to extend in a direction perpendicular to the direction in that arm portion 73 projects. A pair of projecting portions 75 are provided on inclined plate 72. Grooves 76 each having an arc cross section are defined on the respective inner side surfaces of projecting portion 75, which face each other. When cam mechanism 70 is assembled, after ball 7 is inserted into through holes 74 of rotor 71, both the upper and lower portions of ball 7 that protrude from hole 74 are inserted into respective grooves 76. Ball 7 engages both of hole 74 and grooves 76, thereby engaging rotor 71 and inclined plate 72 in the direction of the axis of the drive shaft. In cam mechanism 70 according to this seventh embodiment, substantially the same advantages as those in the first through sixth embodiments may be obtained.

Although the above-described embodiments have been explained with respect to a variable-displacement inclined plate compressor having an inclined plate and a wobble plate, the present invention may be applied to a variable-displacement inclined plate compressor which does not have a wobble plate. In such a compressor, the force from an inclined plate may be transmitted to piston rods and pistons, for example, via a shoe mechanism. For example, a shoe may be provided on an end of each piston rod, and the shoe may slidably engage the rotating inclined plate. The cam mechanism between a rotor and an inclined plate according to the present invention may be applied to this type of compressor, and also similarly to the above-described embodiments.

Although several embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A variable-displacement inclined plate compressor including a drive shaft, a rotor provided on said drive shaft, and an inclined plate provided around said drive shaft and rotated synchronously with said drive shaft via said rotor, said compressor comprising:

a cam mechanism provided between said rotor and said inclined plate for controlling an inclination angle of said inclined plate relative to an axis of said drive shaft, said cam mechanism comprising a ball located between said rotor and said inclined plate, wherein a hole is defined in one of said rotor and said inclined plate, a groove is defined in the other of said rotor and said inclined plate, said ball is contained in said hole and moves along said groove, and said ball moves freely if said hole and said groove, wherein a gap is formed between at least a portion of said rotor positioned outside of said groove or outside of said hole and positioned adjacent to said ball, and a portion of said inclined plate positioned outside of said groove or outside of said hole and positioned adjacent to said ball.

2. The variable-displacement inclined plate compressor of claim 1, wherein said hole is formed as a cylindrical hole, and said groove is formed with a rectangular cross section.

3. A variable-displacement inclined plate compressor including a drive shaft, a rotor provided on said drive shaft, and an inclined plate provided around said drive shaft and rotated synchronously with said drive shaft via said rotor, said compressor comprising:

a cam mechanism provided between said rotor and said inclined plate for controlling an inclination angle of said inclined plate relative to an axis of said drive shaft, said cam mechanism comprising a ball located between said rotor and said inclined plate, wherein a hole is defined in one of said rotor and said inclined plate, a groove is defined in the other of said rotor and said inclined plate, and said ball is contained in said hole and moves along said groove, and wherein said hole is formed as a semi-spherical hole, and said groove is formed with a semi-circular cross section.

4. The variable-displacement inclined plate compressor of claim 3, wherein a diameter of said semi-circular cross section of said groove is slightly larger than a diameter of said ball.

5. A variable-displacement inclined plate compressor including a drive shaft, a rotor provided on said drive shaft, and an inclined plate provided around said drive shaft and rotated synchronously with said drive shaft via said rotor, said compressor comprising:

a cam mechanism provided between said rotor and said inclined plate for controlling an inclination angle of said inclined plate relative to an axis of said drive shaft, said cam mechanism comprising a ball located between said rotor and said inclined plate, wherein a hole is defined in one of said rotor and said inclined plate, a groove is defined in the other of said rotor and said inclined plate, and said ball is contained in said hole and moves along said groove, wherein said ball moves freely in said hole and said groove, said hole is formed as a conical hole, and said groove is formed with a triangular cross section.

6. A variable-displacement inclined plate compressor including a drive shaft, a rotor provided on said drive shaft, and an inclined plate provided around said drive shaft and rotated synchronously with said drive shaft via said rotor, said compressor comprising:

a cam mechanism provided between said rotor and said inclined plate for controlling an inclination angle of said inclined plate relative to an axis of said drive shaft, said cam mechanism comprising a ball located between said rotor and said inclined plate, wherein a hole is defined in one of said rotor and said inclined plate, a groove is defined in the other of said rotor and said inclined plate, and said ball is contained in said hole and moves along said groove, and wherein a lubricating oil hole is provided in at least one of said hole and said groove.

7. A variable-displacement inclined plate compressor including a drive shaft, a rotor provided on said drive shaft, and an inclined plate provided around said drive shaft and rotated synchronously with said drive shaft via said rotor, said compressor comprising:

a cam mechanism provided between said rotor and said inclined plate for controlling an inclination angle of said inclined plate relative to an axis of said drive shaft, said cam mechanism comprising a ball located between said rotor and said inclined plate, wherein a hole is defined in one of said rotor and said inclined plate, a groove is defined in the other of said rotor and said inclined plate, said ball is contained in said hole and moves along said groove, and said ball moves freely in said hole and said groove, wherein at least a portion of said rotor positioned outside of said groove or outside of said hole and positioned adjacent to said ball is spaced from a portion of said inclined plate positioned outside of said groove or outside of said hole and positioned adjacent to said ball.

* * * * *